United States Patent [19]

Duppstadt

[11] Patent Number: 4,979,337

[45] Date of Patent: Dec. 25, 1990

[54] POLISHING TOOL FOR CONTACT LENSES AND ASSOCIATED METHOD

[76] Inventor: Arthur G. Duppstadt, R.D. #5, Box 100, Leechburg, Pa. 15656

[21] Appl. No.: 914,872

[22] Filed: Oct. 3, 1986

[51] Int. Cl.[5] ..... B23F 21/33

[52] U.S. Cl. ..... 51/209 R; 51/210; 51/DIG. 34; 51/358

[58] Field of Search ..... 51/209 R, 210, 284 R, 51/284 E, 358, 376, 377, 378, 381, 382, DIG. 34

[56] References Cited

U.S. PATENT DOCUMENTS

| | | | |
|---|---|---|---|
| 1,988,649 | 1/1935 | Evans | 51/381 X |
| 2,282,650 | 5/1942 | Fenton | 51/DIG. 34 |
| 2,309,836 | 2/1943 | Fenton | 51/185 |
| 2,749,681 | 6/1956 | Reidenbach | 51/195 |
| 2,990,664 | 7/1961 | Cepero | 51/284 |
| 3,050,909 | 8/1962 | Rawstron | 51/381 X |
| 3,087,284 | 4/1963 | Kratt | 51/DIG. 34 |
| 3,142,138 | 7/1964 | Kean et al. | 51/209 R X |
| 3,144,737 | 8/1964 | Faas | 51/185 |
| 3,160,039 | 12/1964 | Rocher et al. | 82/13 |
| 3,238,676 | 3/1966 | Borish | 51/284 |
| 3,517,466 | 6/1970 | Bouvier | 51/358 |
| 3,578,850 | 5/1971 | Grant | 51/284 X |
| 3,583,111 | 6/1971 | Volk | 51/358 |
| 3,916,574 | 11/1975 | Prunier | 51/124 L |
| 4,291,508 | 9/1981 | Prunier | 51/395 |

FOREIGN PATENT DOCUMENTS

| | | | |
|---|---|---|---|
| 254878 | 1/1944 | Switzerland | 51/358 |
| 2039810 | 8/1980 | United Kingdom | 51/DIG. 34 |

*Primary Examiner*—Frederick R. Schmidt
*Assistant Examiner*—M. Rachuba
*Attorney, Agent, or Firm*—Arnold B. Silverman

[57] ABSTRACT

A polishing tool for contact lenses and an associated method is provided. The polishing tool is comprised of a base, an exteriorly convex resilient polishing head, and a polishing cloth. The polishing head is made of a suitable resilient material, said material allowing the polishing head to better conform to the interior portion of the contact lens. The method of the present invention involves connecting the polishing tool to a rotatable shaft and exposing the rotating polishing head to the interior of the contact lens. The polishing head can be adapted, in another embodiment, to polish the edges and the outside and peripheral bevels of a contact lens.

10 Claims, 1 Drawing Sheet

POLISHING TOOL FOR CONTACT LENSES AND ASSOCIATED METHOD

BACKGROUND OF THE INVENTION

1. Field Of The Invention

This invention relates generally to a polishing tool for contact lenses and an associated method and more specifically, to a product and method that polishes the central optical section, the edges and the outside and peripheral bevels of a contact lens to very precise tolerances.

2. Description Of The Prior Art

Polishing a contact lens is necessary in order to achieve a proper fit between the contact lens and the eye. The more precisely and smoothly polished a contact lens is the sharper the image the wearer can obtain and the more comfortably the contact lens will fit the wearer.

The prior art contains polishing tools that have polishing heads mounted on a rigid base (usually brass) of an exact curve. It is important to have a rigid tool in order to implant its curve to the central optical portion of the contact lens in order to achieve good optical clarity.

Another aspect of contact lens fitting involves polishing the outside and peripheral bevels and the edges of a contact lens. In the periphery of the cornea, where the outer part of the contact lens fits, there is a flatenning of the corneal curve. This must be imitated by the inside periphery of the contact lens to provide for complementary configurations. It has been known in the art to employ a series of curved grinding balls to make these bevels, this variable surface then being polished with the same type rigid tools described above as were used in polishing central curves. This method, however, produced an uneven contact lens surface having a series of ridges in the junction or shoulder regions where the peripheral bevels and the central optical curves met.

U.S. Pat. No. 3,583,111, while not related to contact lenses, discloses a lens grinding apparatus comprising an abrasive disc fastened to a resilient cushion and a holder. The lens is placed on a rotating table and is brought in contact with the abrasive disc in order to polish the lens. The metal portion determines the shape of the polishing tool.

U.S. Pat. No. 3,517,466, which also does not relate to contact lenses, discloses a polishing wheel for contoured surfaces. Abrasive-faced studs are mounted on a stud carrying disc that is in turn mounted on a sponge rubber material. These layers are then mounted on a steel plate that engages a steel shaft.

U.S. Pat. No. 2,990,664 shows a method of finishing the edges of a contact lens. The lens is held on a lens holder, and the method involves twelve steps including beveling, touch polishing of the bevel, and creating the secondary curve.

U.S. Pat. No. 3,238,676 discloses various means for polishing the exterior of a contact lens by means of an enlarged concave surface.

Several patents disclose different types of grinding pads that can be used in association with a lens grinding tool. See, e.g., U.S. Pat. Nos. 3,144,737 and 3,578,850.

There remains a need for a contact lens polishing apparatus that polishes the interior surface, or central optical zone, the edges and the outside and peripheral bevels of a contact lens to a smooth blended predetermined curved shape. There also remains a need for a resilient polishing tool that can be easily manufactured into many different specific and exact curves so as to facilitate different central optical section curvatures and different edge and outside and peripheral bevel shapes.

SUMMARY OF THE INVENTION

The present invention has produced a solution to the above-described needs by providing a polishing tool for contact lenses and an associated method. The polishing tool has a base, an exteriorly convex resilient polishing head of predetermined spheric or aspheric curved shape, and a polishing member, which may be a cloth, in overlying contact with the polishing head. The base may be secured to a rotatable shaft, such as a motor shaft, by means of a shaft opening in the base or by other means. The polishing head may be made of any suitable resilient material, said material enabling the polishing head to better conform to the various surfaces on a contact lens. The polishing member is preferably secured to the resilient polishing head by suitable means.

The method of the present invention involves connecting the polishing tool to a rotatable shaft and contacting the rotating polishing head to the central optical section of the contact lens. Another embodiment of the polishing tool can be used to polish the outside and peripheral bevels and the edges of a contact lens.

It is an object of the invention to provide a contact lens polishing tool and associated method that precisely contours the central optical section, the edges and the peripheral and outside bevels of a contact lens.

It is an object of the invention to provide a polishing tool that will not distort the optics of a contact lens if a polishing tool of a somewhat too steep a curvature is used.

It is an object of the invention to provide a polishing tool that more quickly polishes a contact lens than conventional brass tools.

It is an object of the invention to provide a polishing tool with a resilient polishing head that allows the polishing head and polishing cloth to smoothly contour uneven surfaces present in contact lenses.

It is an object of the invention to provide a contact lens polishing tool that is easy to mount and use.

It is an object of the invention to provide a contact lens polishing tool that can be used with different types of polishing cloths with different mounting mechanisms.

It is an object of the invention to provide easy manufacture of polishing tools of different sizes and curvatures.

It is an object of the invention to provide an alternate embodiment of the polishing head to facilitate polishing the edges and the peripheral and outside bevels of a contact lens.

It is an object of the invention to use materials such as silk on the polishing tool to polish specified small areas instead of using thick fuzzy pads associated with prior art rigid tools.

It is a further object of the invention to provide a soft tool that polishes the outside bevels of a contact lens to cut down on spherical aberration.

These and other objects of the invention will be fully understood from the following description of the invention with reference to the illustrations appended hereto.

DESCRIPTION OF THE PREFERRED EMBODIMENTS

Figure 1:
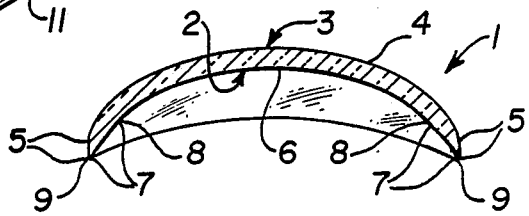
FIG. 1 is an enlarged cross-sectional view of a contact lens upon which the polishing tool of the present invention operates.

FIG. 1 shows an enlarged illustration of a contact lens upon which the polishing tool operates. The contact lens 1 has an interior portion 2 which contacts the eyeball of the wearer and an exterior portion 3 which does not contact the eyeball of the wearer. The exterior portion 3 is further comprised of an outside curve 4 and two outside bevels 5. The interior portion 2 is comprised of a base curve or central optical section 6 and two peripheral bevels 7. The junction or shoulder 8 is the point where the optical section 6 and the peripheral bevels 7 meet. Two edges 9 are formed at where the exterior portion 3 and the interior portion 2 meet. The contact lens 1 can be hard or soft.

Figure 2:
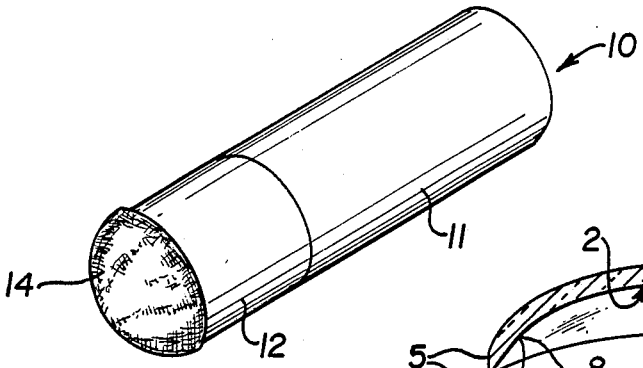
FIG. 2 is a perspective view of the polishing tool of the present invention.

FIG. 2 shows one of the preferred embodiments of the polishing tool. The polishing tool 10 consists of a base 11, an exteriorly convex resilient polishing head 12 and a polishing member 14. It is preferred that the polishing tool 10 have a generally cylindrical shape with a convex end. It may, for example, have an overall length of about $\frac{3}{4}$ to 3 inches and be approximately $\frac{3}{8}$ to 1 inch in diameter in the cylindrical region. It will be appreciated that different lengths and widths can be used depending on particular needs.

Figure 3:
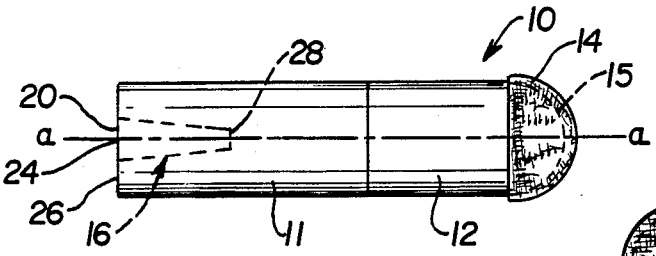
FIG. 3 is an elevational view of the polishing tool of FIG. 2.
Figure 4:
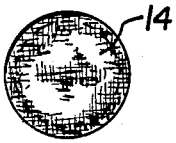
FIG. 4 is a right side elevational view of the polishing tool of FIG. 3.

Referring to FIG. 3, the polishing tool shown is preferably symmetrical about axis a—a. The polishing tool 10 consists of a base 11, an externally convex resilient polishing head 12, and a polishing member 14, which is preferably a cloth, secured in intimate overlying relationship with respect to the domed portion 15 of the polishing head 12. If desired, the base 11 and polishing head 12 may be formed of a unitary body rather than being two components joined by any suitable means such as adhesive or welding, for example. The base 11 is preferably made of materials selected from the group consisting of synthetic rubber, tetrafluoroethylene (sold under the trade designation, "Teflon"), nylon, acetal resins (sold under the trade designation, "'Delrin"), or other stable machinable material. The polishing head 12, which may be 7/16" to $\frac{5}{8}$" in diameter, for example, can be made of synthetic rubber or any other material that can be machined or formed to a specific aspheric or spheric curve and that is resilient and strong enough to maintain the desired curvature. The hardness of <the polishing head 12 preferably ranges from about 30 to 90 durometer hardness (shoe points method). The base 11 and polishing head 12 can be made of the same material to facilitate molding a single unit comprising of a base 11 and a polishing head 12.

The polishing head 12 is resilient in order to facilitate better conformance to the interior portion 2 of a contact lens. This resiliency resists undesired distortion of the optics of the contact lens if a polishing tool of a little too steep curvature is used and, also quickens polishing of the contact lens because the polishing head 12 has more contact with the interior portion 2 of the contact lens as compared to a brass tool.

The polishing cloth 14, which may be made of cotton, silk, or other suitable materials such as those products sold under the trade designations "Pellon" or "Velveteen" is preferably fixedly secured to the polishing head 12 by adhesive means such as a pressure sensitive adhesive or the like.

Figure 5:
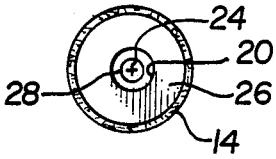
FIG. 5 is a left side elevational view of the polishing tool of FIG. 3.

The polishing tool 10 is mounted on a rotation creating power source (not shown) by a rotary shaft engaging means 16 which in this embodiment is a shaft opening 20 formed into the center 24 of the bottom portion of the base 26 which can best be seen in FIG. 5. The shaft opening 20 is preferably tapered towards closed end 28 to facilitate more intimate engagement between the shaft opening 20 and the rotation power source. The power source is preferably equipped with a speed control to provide different rotational speeds for the polishing tool 10.

Figure 6:
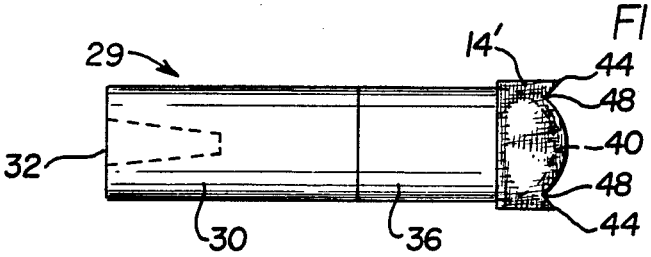
FIG. 6 is an elevational view of another embodiment of the polishing tool.
Figure 7:
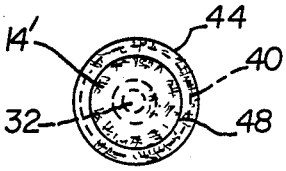
FIG. 7 is a right side elevational view of the embodiment of the polishing tool shown in FIG. 6.

Another embodiment of the polishing tool is shown in FIGS. 6 and 7. This embodiment shows a base 30 which may be similar to base 11 and shaft opening 32 and polishing cloth 14', as was shown above, however the polishing head 36 has a central dome 40, and an annular ridge 44 with an annular recess 48 therebetween. This configuration can best be seen in FIGS. 6–9.

Figure 8:
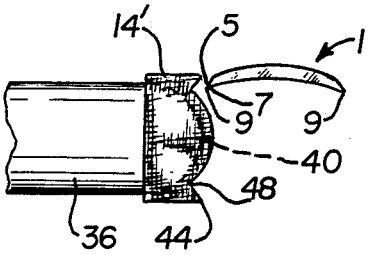
FIG. 8 is a partial elevational view of the operation of the polishing tool shown in FIG. 6 on a contact lens.

This embodiment of the polishing tool is not only used to polish the interior portion 2 of a contact lens, but also used to polish the outside bevels 5, the peripheral bevels 7 and edges 9 of the contact lens 1. As seen in FIG. 8, a contact lens 1 is placed in the annular recess 48 which is shaped to correspond to the edges 9 and bevels 5,7 of a contact lens 1 such that the edges 9 and the bevels 5,7 of the contact lens can be polished. Polishing of the edges 9 and bevels 5,7 is necessary to insure proper fit of the contact lens on the wearer's eye.

Figure 9:
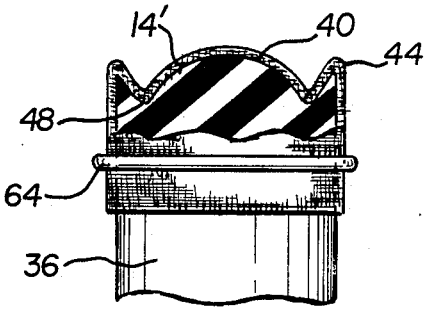
FIG. 9 is a partial cross-section showing the embodiment of the polishing tool shown in FIG. 6 with the polishing cloth fixedly secured to the polishing head with an O-ring.

FIG. 9 shows an alternate method of mounting a polishing cloth 14' on the polishing head 36 of the polishing tool embodiment shown in FIG. 6. The polishing cloth 14' is placed in overlying contact with the polishing head 36. The polishing cloth is held in place in a preferred form by elastic band means 64 such as an O-ring that engages C of the polishing cloth 14' providing tension to hold the polishing cloth 14' in the desired portion of the polishing head 36. The elastic means 64 is preferably a rubber band. In lieu thereof other means such as a pressure sensitive adhesive means may be employed. It will be appreciated that the above polishing cloth mounting means can be used with all embodiments of the polishing tool and the means disclosed for retention of the polishing cloth in the embodiment of FIGS. 2–5 may be employed with this embodiment.

Figure 10:
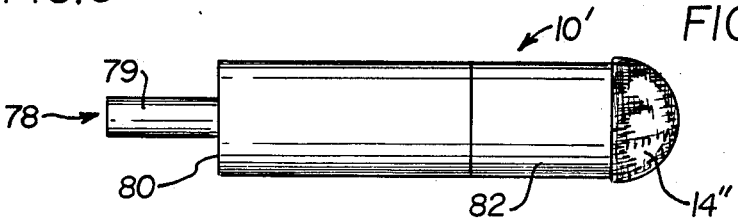
FIG. 10 is an elevational view of the polishing tool of FIG. 2 with an alternate mounting mechanism.
Figure 11:
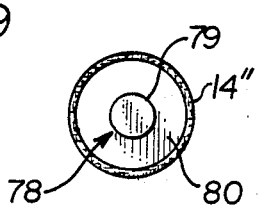
FIG. 11 is a left side elevational view of the polishing tool of FIG. 10.

FIG. 10 shows an alternate embodiment of the polishing tool 10′ with polishing cloth 14″ with an alternate mounting structure 78. The mounting structure 78 includes a cylindrical shaft 79 protruding from the base 80. This can best be seen by viewing FIGS. 10 and 11. The shaft 79 can be constructed of materials selected from the group consisting of synthetic rubber, tetrafluoroethylene (sold under the trade designation, "Teflon"), nylon, acetal resins (sold under the trade designation, "Delrin"), or other stable machinable material, or can be molded into a single unit with the base 80 and polishing head 82.

It will be appreciated that the method of the invention involves providing the polishing tool as described above, mounting the tool on a motor or other power driven shaft, rotating the polishing tool, and contacting the resilient externally convex area of the polishing head of the polishing tool with the interior portion of the contact lens. Polishing the edges and the outside and peripheral bevels of the contact lens involves mounting the alternate embodiment of the polishing tool, rotating the tool, and contacting the edges and the outside and peripheral bevels of the contact lens with the polishing tool to polish these areas. An operator can contact different parts of the edges or the outside and peripheral bevels by canting or tilting the contact lens with respect to the tool to obtain desired polishing and curvature of a contact lens.

It will be appreciated that the polishing head, due to its resiliency, will better conform to the interior portion of the contact lens, thus providing a polishing tool that can better smooth the interior portion which, in turn, increases the quality of the contact lens. The polishing head can be formed to an exact curve and the polishing cloth, which can be silk as opposed to bulkier fuzzy pads, can be used to polish specific areas of the contact lens without disturbing other areas of the contact lens. The polishing tool is simple to manufacture and can be made into several polishing head sizes and curvatures. By way of example, a set of twenty seperate polishing tools of different curvatures and sizes will adequately serve a majority of a contact lens maker's requirements.

It can also be appreciated that the outside edges and peripheral and outside bevels of the contact lens can also be polished effectively with the polishing tool. The use of the polishing tool smooths the junction or shoulder, thus creating a smooth blended curve that greatly enhances the comfort of wearing the contact lens. Polishing the bevels with the alternate embodiment of the polishing tool resists spherical aberration of the contact lens, while at the same time not disturbing the central optical section of the contact lens.

Whereas particular embodiments of the invention have been described above, for purposes of illustration, it will be evident to those skilled in the art that numerous variations of the details may be made without departing from the invention as defined in the appended claims.

I claim:

1. A polishing tool for a contact lens comprising:
a body having a base and a resilient polishing head;
a polishing member which is a non-abrasive polishing cloth, in intimate surface-to-surface contact with said polishing head;
said resilient polishing head being made of material selected from the group consisting of synthetic rubber, tetrafluoroethylene, nylon, and acetal resins;
said resilient polishing head being convexly curved to imitate the configuration of the interior portion of a contact lens;
said resilient polishing head having a hardness of about 30 to 90 durometer hardness;
said resilient polishing head having a diameter of about ⅜″ to 1″; and
said resilient polishing head having a central dome and an annular ridge spaced from said central dome, and an annular recess disposed between said central dome and said annular ridge.

2. The polishing tool of claim 1, including
said annular recess generally conforming in size and shape to the edges and outside and peripheral bevels of said contact lens.

3. A method of polishing a contact lens comprising
providing a polishing tool consisting of a body, a resilient polishing head having a central dome and an annular ridge spaced from said central dome and an annular recess disposed between said central dome and said annular ridge, and a polishing member which is a non-abrasive polishing cloth in overlying relationship with said polishing head,
mounting said polishing tool on a rotatable shaft,
rotating said polishing tool, and
contacting said polishing member with said contact lens, whereby said contact lens is polished.

4. The method of claim 3, including
polishing the interior surface of said contact lens.

5. The method of claim 4, including
polishing the edges of said contact lens.

6. The method of claim 5, including
polishing the outside bevels of said contact lens.

7. The method of claim 6, including
polishing the peripheral bevels of said contact lens.

8. The method of claim 7, including
providing said contact lens having said outside and peripheral bevels, said edges, and a central optical section,
polishing said outside and peripheral bevels, said edges and said central optical section of said contact lens so that a smooth blended curve is created for said interior portion of said contact lens whereby fit and comfort of said contact lens is enhanced.

9. The method of claim 8, including
polishing said edges and said peripheral and outside bevels of said contact lens so that the central optical section of said contact lens is not disturbed.

10. The method of claim 8, including employing silk or cotton as said non-abrasive polishing cloth.

* * * * *